United States Patent [19]

Mahoney, deceased et al.

[11] 4,412,679

[45] Nov. 1, 1983

[54] FOLDABLE BASKETBALL GOAL MEANS

[76] Inventors: Elmo J. Mahoney, deceased, late of Dorrance, Kans., by Regina B. Mahoney, executrix; Kenneth J. Mahoney, Dorrance, Kans. 67634

[21] Appl. No.: 264,127

[22] Filed: May 15, 1981

Related U.S. Application Data

[63] Continuation of Ser. No. 946,386, Sep. 27, 1978, abandoned.

[51] Int. Cl.[3] ..... A63B 63/08

[52] U.S. Cl. ..... 273/1.5 R; 16/115; 248/129; 248/404

[58] Field of Search ..... 273/1.5 R, 1.5 A; 248/404, 129; 272/64; 16/115; 172/269, 264

[56] References Cited

U.S. PATENT DOCUMENTS

| | | | |
|---|---|---|---|
| 892,080 | 6/1908 | Pishek | 16/115 |
| 1,013,685 | 1/1912 | Reach | 248/129 UX |
| 2,045,083 | 6/1936 | Illig | 16/115 X |
| 2,553,105 | 5/1951 | Morey | 273/1.5 R |
| 2,695,759 | 11/1954 | Crosslin | 248/404 |
| 2,697,244 | 12/1954 | Lincke | 16/115 |
| 2,935,144 | 5/1960 | Graham | 172/269 |
| 2,986,395 | 5/1961 | Sheftel | 273/1.5 R |
| 3,017,183 | 1/1962 | Chalcroft | 273/1.5 R |
| 3,050,304 | 8/1962 | Holsebus | 273/1.5 R UX |
| 3,224,790 | 12/1965 | Holstein | 16/115 X |
| 3,881,724 | 5/1975 | Beveridge | 273/1.5 R |
| 3,960,220 | 6/1976 | Laitala | 172/269 X |
| 4,111,420 | 9/1978 | Tyner | 273/1.5 R |
| 4,365,802 | 12/1982 | Ehrat | 273/1.5 R |

FOREIGN PATENT DOCUMENTS

| | | | |
|---|---|---|---|
| 604945 | 9/1960 | Canada | 172/264 |
| 6413102 | 5/1966 | Netherlands | 273/1.5 R |
| 870085 | 6/1961 | United Kingdom | 272/64 |

OTHER PUBLICATIONS

The Sporting Goods Dealer, 6-1976, p. 131, Backstop designed for tandem use.

*Primary Examiner*—Paul E. Shapiro
*Attorney, Agent, or Firm*—Phillip A. Rein

[57] ABSTRACT

This invention is a foldable basketball goal means having a plurality of basketball goal assemblies, namely two or four counterbalanced units, which are individually movable from a usage position to a folded position and being lowered from an elevated usage position for movement through conventional gymnasium door structures. More particularly, the foldable basketball goal means includes a basketball goal means; a goal support means having one end connected to the basketball goal means; a base support means connected to a lower end of the goal support means in order to raise and lower the basketball goal means. The main base support means includes an actuator wheel assembly which acts automatically on raising and lowering of the basketball goal means to anchor the main base support means in the usage condition or raise the main base support means for lateral movement in all directions of the entire invention to a desired location.

12 Claims, 13 Drawing Figures

FOLDABLE BASKETBALL GOAL MEANS

This is a continuation of application Ser. No. 946,386, filed Sept. 27, 1978, now abandoned.

PRIOR ART

A search of the prior art relative to this invention revealed the following references:

U.S. Pat. Nos. 3,050,304; 3,814,421; and 2,198,283.

The only pertinent reference is U.S. Pat. No. 3,050,304, inventor Hulsebus, which discloses a four sided basketball practice device with a central chamber used to (1) protect players from running into each other; and (2) store equipment such as basketballs therein.

None of the prior art devices are foldable and operable similar to the invention described herein, and therefore, are not deemed pertinent.

SPECIAL EMBODIMENT OF THE INVENTION

In one preferred embodiment of the invention, a two or four sided, foldable basketball goal means includes (1) a basketball goal means having two or four counterbalanced individual basketball goal assemblies each facing different directions; (2) a goal support means connected at an upper end to the basketball goal means; (3) a main base support means connected to a lower end of the goal support means to give lateral support to the basketball goal means; and (4) an actuator control means mounted within the main base support means and operably connected to the goal support means. Each of the basketball goal assemblies include a goal and rim assembly foldable from a vertical usage position to an inverted position being 180 degrees from the usage position for transport and storage purposes. The goal support means includes a main support tube member having an upper tube member telescopingly mounted in the main support tube member. The upper tube member is selectively movable vertically to adjust the desired height of the basketball goal means for either (1) storage purposes, or (2) variable usage heights. The main base support means includes an actuator wheel assembly mounted within a base support assembly. The actuator wheel assembly is operable on lowering of the upper tube member to raise the base support assembly on wheel members thus allowing lateral movement of the entire structure of this invention in any direction. The actuator control means includes a fluid pump means connected to a piston and cylinder assembly which, in turn, is connected to the upper tube member. The fluid pump means is operable to raise and lower the upper tube member and the interconnected basketball goal means.

OBJECTS OF THE INVENTION

One object of the invention is to provide a foldable basketball goal means having the features of (1) a plurality of goal and rim assemblies, each foldable from a usage position to an inverted non-usage position; (2) means to raise and lower the goal and rim assemblies; and (3) means to raise the structure onto wheel members for lateral movement thereof as desired.

Another object of the invention is to provide a foldable basketball goal means having two or four goal and rim assemblies counterbalanced and each facing an opposite horizontal direction thus being counterbalanced and having open space thereunder for practicing, dunking, lay-ups, etc.

Still, one further object of this invention is to provide a foldable basketball goal means including a plurality, namely two or four, basketball goal assemblies that can be (1) folded from an upright usage position to an inverted storage position; (2) lowered to a non-usage position so as to be moved through conventional door structures; and (3) moved laterally in any direction on wheel members to a desired location.

One other object of this invention is to provide a basketball goal means having a plurality of goal and rim assemblies with each having a releasable rim member connected to a backboard goal member whereby the rim member releases from the horizontal position on application of excessive pressure thereon to achieve a safety factor and resist tipping over of the entire structure of this invention.

Still, another object of this invention is to provide a foldable basketball goal means that is (1) rigid in construction; (2) adjustable in height for players of various ages; (3) movable into a folded, lowered conditions for storage purposes; (4) easy to operate, and (5) safe to use.

Various other objects, advantages, and features of the invention will become apparent to those skilled in the art from the following discussion, taken in conjunction with the accompanying drawings in which:

FIGURES OF THE INVENTION

Figure 1:
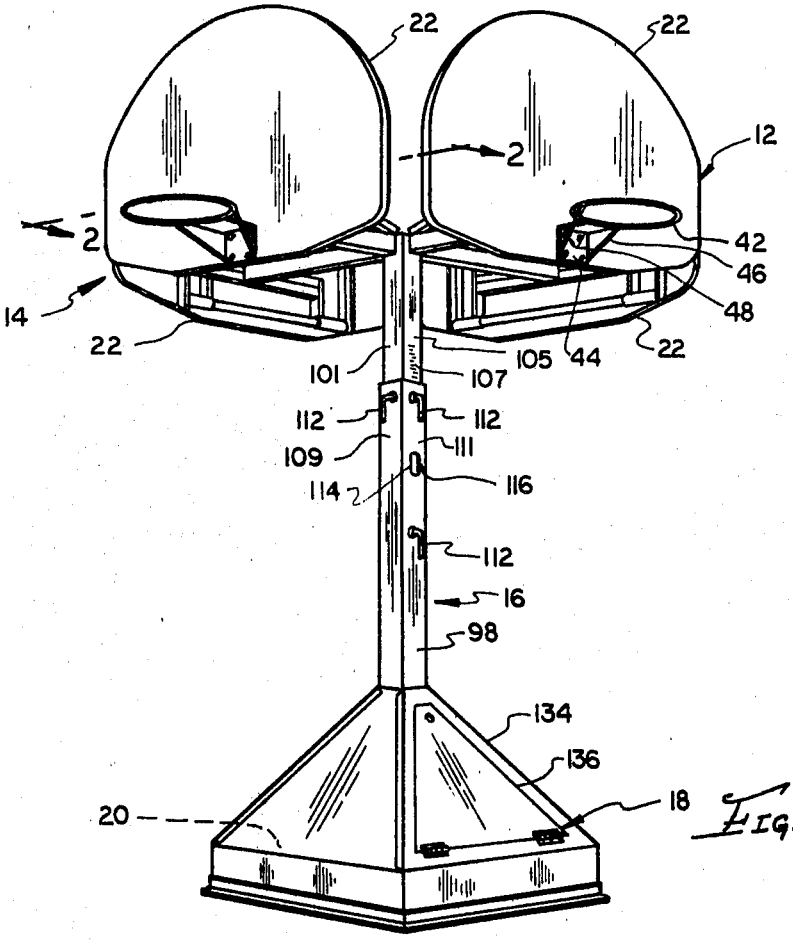
FIG. 1 is a perspective view of a four sided, foldable basketball goal means of this invention.

The following is a discussion and description of preferred specific embodiments of the new four sided, foldable basketball goal means of this invention, such being made with reference to the drawings, whereupon the same reference numerals are used to indicate the same or similar parts and/or structure. It is to be understood that such discussion and description is not to unduly limit the scope of the invention.

SPECIFICATION OF THE INVENTION

Referring to the drawings in detail and, in particular to FIG. 1, a four sided, foldable basketball goal means of this invention, indicated generally at 12, includes (1) an elevated, basketball goal means 14; (2) a goal support means 16 having an upper end connected to the basketball goal means 14; (3) a main base support means 18 connected to a lower end section of the goal support means 16; and (4) an actuator control means 20 mounted in the main base support means 18 and operably connected to the goal support means 16 to raise and lower the basketball goal means 14.

The basketball goal means 14 includes a plurality, namely four in this embodiment, of individual basketball goal assemblies 22, each facing in a different horizontal direction. As the units are identical, only one basketball goal assembly 22 need be described in detail. Each basketball goal assembly 22 includes a goal and rim assembly 24 connected to a foldable support assembly 26.

Figure 2:
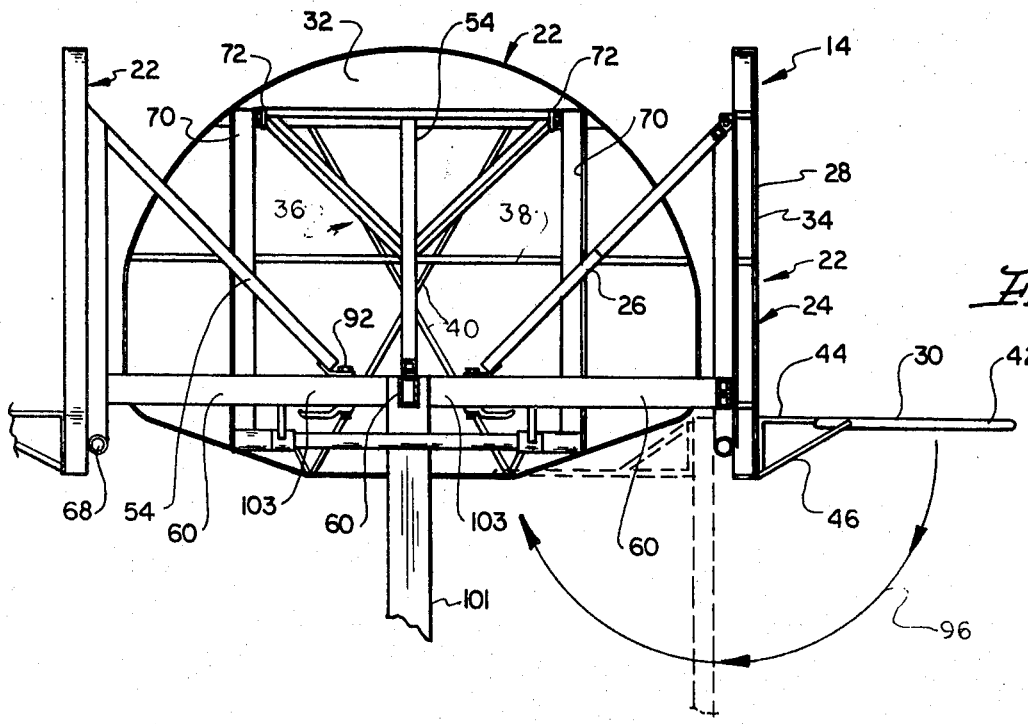
FIG. 2 is a fragmentary sectional view taken along line 2—2 in FIG. 1 with potential movement of a basketball goal assembly indicated by an arcuate arrow.
Figure 4:
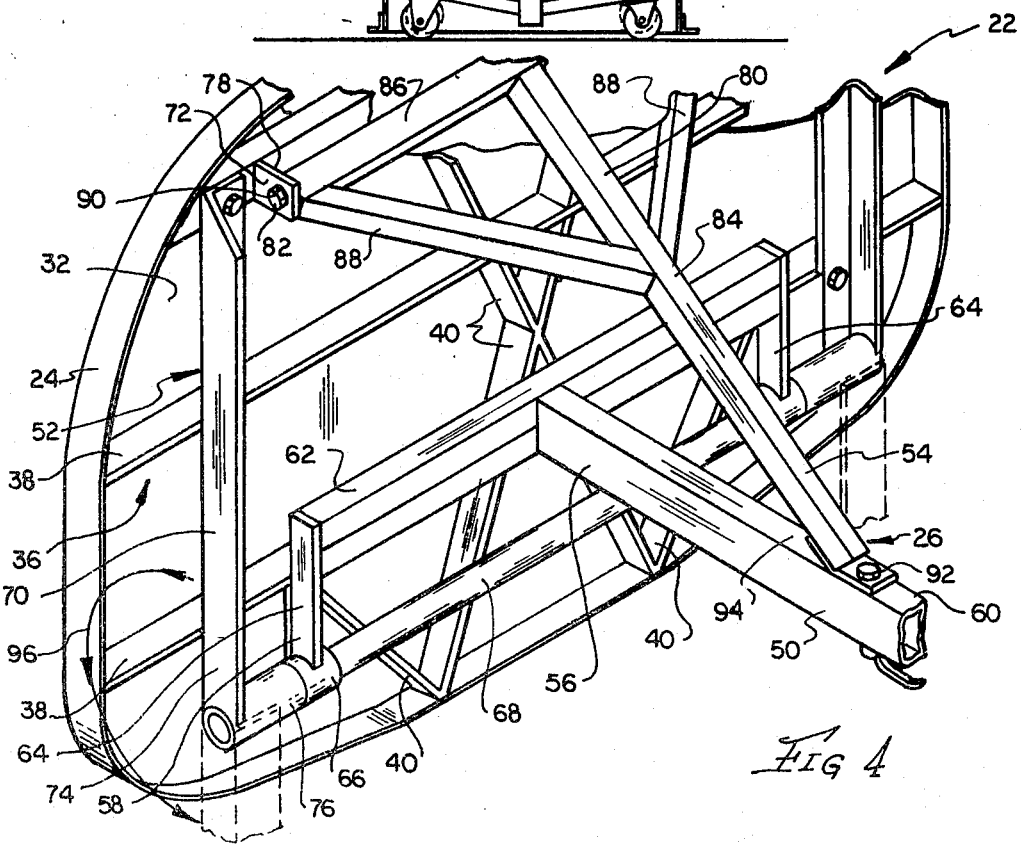
FIG. 4 is a fragmentary perspective view of one basketball goal assembly of the four sided, foldable basketball goal means of this invention.

As shown in FIGS. 2 and 4, the goal and rim assembly 24 includes a conventional goal assembly 28 having a rim assembly 30 connected thereto. The goal assembly 28 includes a standard shaped basketball goal member 32. The goal member 32 includes an outer playing surface 34 being reinforced by support struts 36. The support struts 36 include spaced, parallel horizontal members 38 and diagonal members 40.

The rim assembly 30 includes a basketball ring 42 secured to an L-shaped support member 44 and support arms 46 between the basketball ring 42 and support member 44 for added strength. The support member 44 is secured as by nut and bolt members 48 to the backboard goal member 32 in a conventional manner.

The rim assembly 30 may be replaced by any one of the releasable rim assemblies as shown in a pending patent application entitled Break-Away Basketball Goal Apparatus, Ser. No. 845,925, filed Oct. 27, 1977. The use of a releasable rim assembly in this invention is important as adds a greater safety factor to prevent tipping over of the four sided, foldable basketball goal means 12 of this invention when one ducks a basketball and grasps onto the basketball ring.

As best shown in FIG. 4, each foldable support assembly 26 includes a horizontal support assembly 50; a goal support assembly 52 connected to the backboard goal member 32; and an inclined connector assembly 54 mounted between the horizontal support assembly 50 and the goal support assembly 52. The horizontal support assembly 50 includes a support tee assembly 56 connected to a pivotal connector assembly 58.

The support tee assembly 56 includes a main lateral member 60; a transverse member 62 connected to an outer end of the lateral member 60; and a downwardly depending support arm 64 connected to each outer end of the lateral member 60. Each pivotal connector assembly 58 includes a coupling member 66 secured to a lower end of the support arm 64 and having a rotatable connector shaft 68 mounted therein.

The goal support assembly 52 includes spaced, vertical support members 70 and spaced lateral support members 72, all secured to the back side of the respective goal members 32. The vertical support members 70 include a pair of angle irons 74 each having a connector tube 76 secured to a lower end thereof having the connector shaft 68 secured thereto. The lateral support members 72 are spaced and parallel lug members 78 for connection to the inclined connector assembly 54.

The inclined connector assembly 54 includes an inclined support assembly 80 and a connector assembly 82. The support assembly 80 includes a first support member 84; a transverse second support member 86 secured to an upper end of the first support member 84; and a pair of inclined support members 88 mounted between the first and second support members 84, 86.

The connector assembly 82 includes a connector shaft 90 mounted through the transverse support member 86 and connected to the spaced lug members 78; and a nut and bolt member 92 releasably connecting an outer flat end section of the first support member 84 against an upper surface 94 of the main lateral member 60 (FIG. 4). It is obvious that the entire goal and rim assembly 24 can be pivoted to a folded condition on release of the nut and bolt member 92 and movement in a direction shown by an arrow 96 in a manner to be explained.

The goal support means 16 includes a main support tube member 98 and an upper telescoping tube member 101 mounted within the main tube member 98 for axial movement relative thereto. The tube members 98, 101 are each of square tubular construction as shown in transverse cross section in FIG. 8. An upper end of the telescoping tube member 101 is connected to inner end sections 103 of all the respective main lateral members 60 (FIG. 2). A sidewall 105 of the telescoping tube member 101 is provided with height indicia 107 thereon for reasons to be explained.

Figure 3:
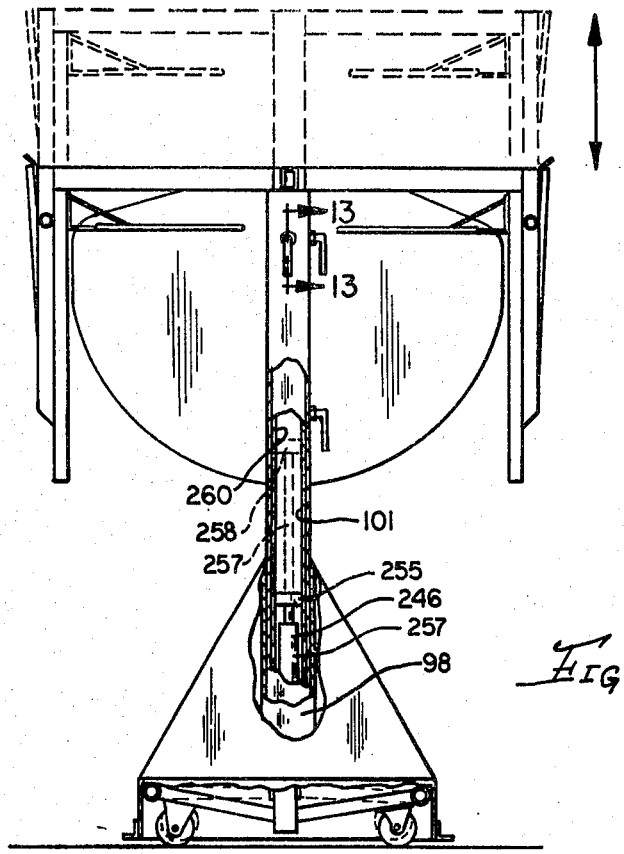
FIG. 3 is a side elevational view of the four sided, foldable basketball goal means of this invention illustrating vertical movement thereof and having portions broken away for clarity.

As shown in FIGS. 1 and 3, adjacent sidewalls 109 and 111 of the main support tube member 98 are provided with lock assemblies 112 and an observation opening 114. An indicia mark 116 at the center of the observation opening 114 is alignable with the height indicia 107 on the telescoping tube member 101 so that the basketball ring 42 can be replaced at a selected, desired height.

Figure 13:
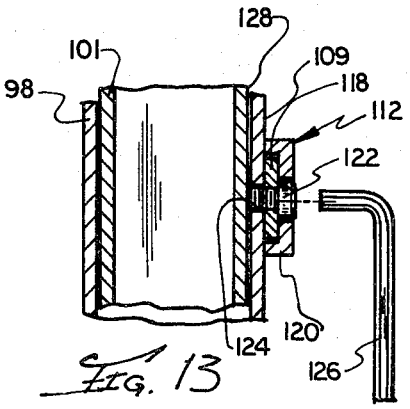
FIG. 13 is an enlarged, fragmentary sectional view taken along line 13—13 in FIG. 3.

As shown in FIG. 13, each lock assembly 112 includes a nut member 118 held against a sidewall 109 or 111 of the main support tube member 98; a nut retainer place 120 secured to the main support tube member 98 to hold the nut member 118; an allen screw 122 threaded into the nut member 118 and extended through a hole 124 in the main support tube member 98; and an allen wrench 126 operable to screw the allen screw 112 inwardly against an outer surface 128 of the telescoping tube member 101 when desired to lock against axial movement. The allen wrench 126 is removed from the allen screw 122 when not used for safety reasons.

The main base support means 18 includes a base support assembly 130 having an actuator wheel assembly 132 mounted thereon.

The base support assembly 130 includes a main support housing 134 having a door and handle assembly 136 connected thereto. The main support housing 134 includes a square, vertical support base 138 connected to an upper inclined top member 140 and a horizontal support plate 142 mounted between the junction of the support base 138 and the top member 140.

The support base 138 includes interconnected vertical support walls 142 having an angle iron member 144 extended about its lower peripherial edges 146 to achieve a greater surface support area 148.

The top member 140 includes inclined sidewalls 142 resembling a pyramid in combination and secured at upper ends thereof to the main support tube member 98.

The horizontal support plate 142 is provided with a stepped section 150 (FIG. 5) and a pair of spaced slots 152 (FIG. 7) to receive and support a portion of the actuator control means 20 therein for reasons to be explained.

As best collectively shown in FIGS. 9 through 12, the door and handle assembly 136 includes an access door member 154; connector hinges 156 pivotally connecting the door member 154 about an opening 158 of similar shape in one of the inclined sidewalls 142 and a handle assembly 160 secured to an inner, upper surface 162 of the door member 154.

Figure 10:
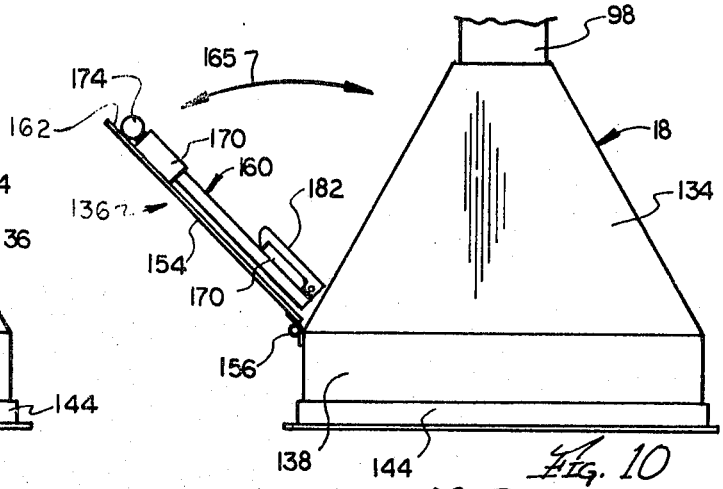
FIG. 10 is a side elevational view similar to FIG. 9 but turned 90 degrees and showing an access door member in the open position.

The access door member 154 is held in place in a closed position by gravity and a hole 164 is provided for ease of opening to a position indicated by an arrow 165 in FIG. 10.

The access door member 154 may be provided with a lock member (not shown) if desired for security reasons.

Figure 11:
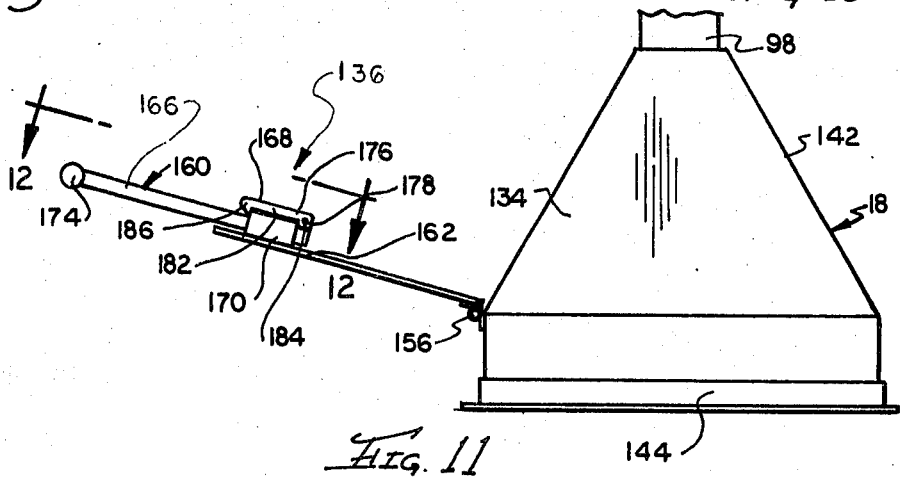
FIG. 11 is a side elevational view similar to FIG. 10 showing a handle member in the extended position.
Figure 12:
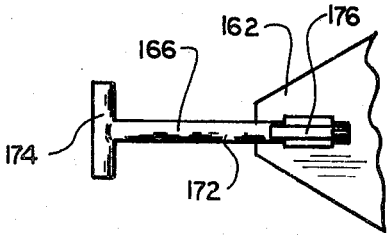
FIG. 12 is a fragmentary sectional view taken along line 12—12 in FIG. 11.

The connector hinges 156 are of a conventional nature and may be constructed to limit pivotal movement of the access door member 154 to the position shown in FIG. 11.

The handle assembly 160 includes a handle member 166 of T-shape; a latch member 168 connected to one end of the handle member 166; and a connector tube 170 secured to the inner surface 162 of the door member 154 and having the handle member 166 connected thereto.

The handle member 166 includes an elongated support section 172 having a grasp or handle section 174 secured to one end thereof.

The latch member 168 includes a latch element 176 pivotally connected by a pin member 178 to an inner end 180 of the support section 172. The latch element 176 includes a main body 182 with a connector section 184 at one end and a hook section 186 at the other.

As seen in FIG. 11, the main body 182 is slightly longer than the connector tube 170 so that, when the handle member 166 is fully extended as shown in FIG. 11, the hook section 186 operates under gravity to hold the connector tube 170 between the hook section 186 and the connector section 184. This allows for pushing movement of the entire four sided, foldable basketball goal means 12 as will be explained.

Figure 6:
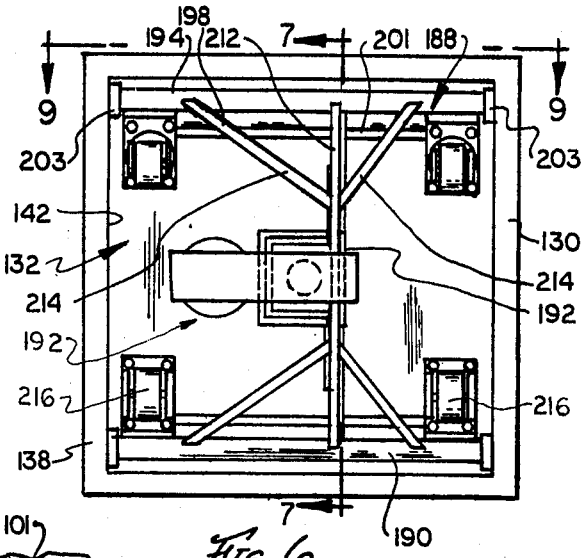
FIG. 6 is a bottom view taken along line 6—6 in FIG. 5.
Figure 7:
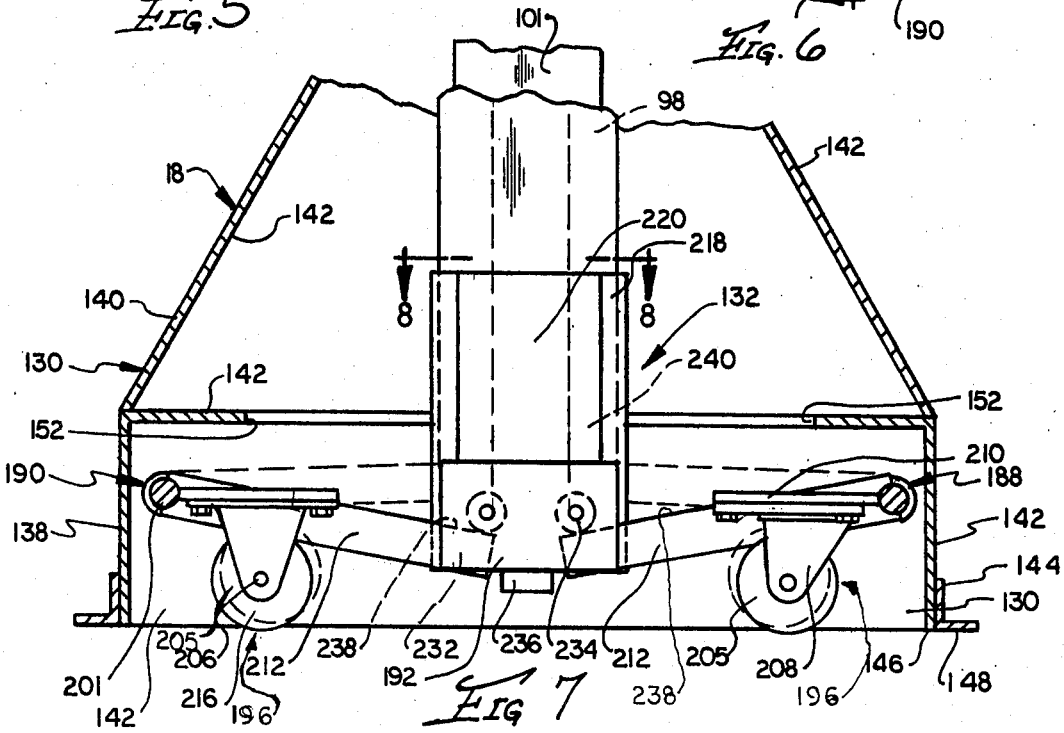
FIG. 7 is an enlarged sectional view taken along line 7—7 in FIG. 6.
Figure 8:
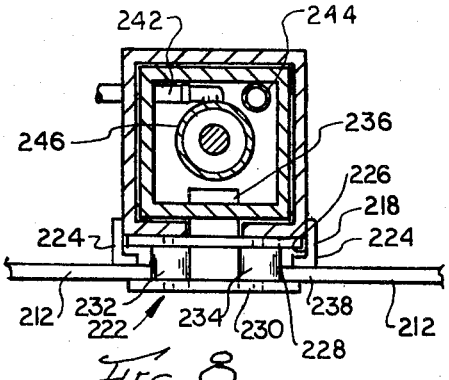
FIG. 8 is a fragmentary sectional view taken along line 8—8 in FIG. 7.
Figure 9:
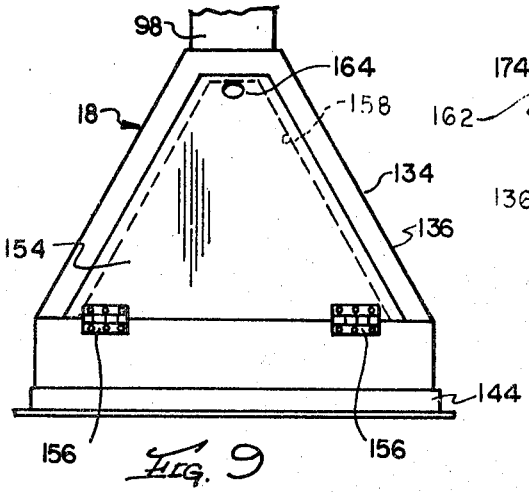
FIG. 9 is a side elevational view of a main base support means of the four sided, foldable basketball goal means of this invention.

As shown collectively in FIGS. 6, 7, and 8, the actuator wheel assembly 132 includes a pivotal first wheel assembly 188, a pivotal second wheel assembly 190, and a wheel actuator assembly 192 operably connected to the goal support means 16 and the first and second wheel assemblies 188, 190.

The first wheel assembly 188 includes a wheel support assembly 194 connected to the base support assembly 130; spaced, wheel assemblies 196 connected to the wheel support assembly 194; and an actuator linkage 198 connected to the wheel support assembly 194.

The wheel support assembly 194 includes an elongated support shaft 201 having opposite ends rotatably mounted in respective support couplings 203 which, in turn, are secured to opposed vertical sidewalls 142 of the vertical support base 138.

As shown in FIG. 7, each wheel assembly 196 includes a castor wheel member 205 mounted by a wheel shaft 206 to parallel wheel support lugs 208. The support lugs 208 are further pivotally connected to a support plate 120 which is anchored as by welding to the support shaft 201 so as to be pivotal therewith.

As best noted in FIG. 6, the actuator linkage 198 includes a wheel actuator arm 212 secured to and extended laterally of the support shaft 201 and connected thereto by diagonal support struts 214 for greater strength. It is noted in FIG. 7 that the wheel actuator arm 212 is movable conjointly with the respective wheel assembly 196 for reasons to be explained.

The pivotal second wheel assembly 190 is substantially identical to the above described first wheel assembly 188 except, instead of castor wheel members 205 being rotatable about the horizontal axis of the wheel shaft 206 plus about a vertical axis wheel members 216 of the second wheel assembly 190 are only rotatable about the horizontal axis of the respective wheel shafts 206.

As noted in FIGS. 7 and 8, the wheel actuator assembly 192 includes a channel housing 218 secured to a lower end section 220 of the main support tube member 98; and a bearing actuator assembly 222 mounted for vertical movement in the channel housing 218 and engagable with the telescoping tube member 101. The channel housing 218 includes a pair of spaced angle iron members 224 forming a guide slot 226 therebetween.

The bearing actuator assembly 222 includes a pair of spaced support plates 228, 230; a pair of spaced bearing members 232, 234, mounted between the support plates 228, 230; and an actuator plate 236 secured to lower adjacent surfaces of the support plates 228, 230.

The inner support plate 228 is restrained between the angle iron members 224 to achieve vertical movement only thereof. The bearing members 232, 234 are operable to engage upper surfaces 238 of respective ones of the wheel actuator arms 212 for movement thereof in a manner to be explained.

The actuator plate 236 extends through a guide slot 240 in the main support tube member 98 and under the lower end of the telescoping tube member 101. It is noted that the telescoping tube member 101 is engagable with the actuator plate 236 and, acting through the bearing members 232, 234 move the wheel actuator arm 212 downwardly to the solid line position shown in FIG. 7 in a manner to be explained.

Figure 5:
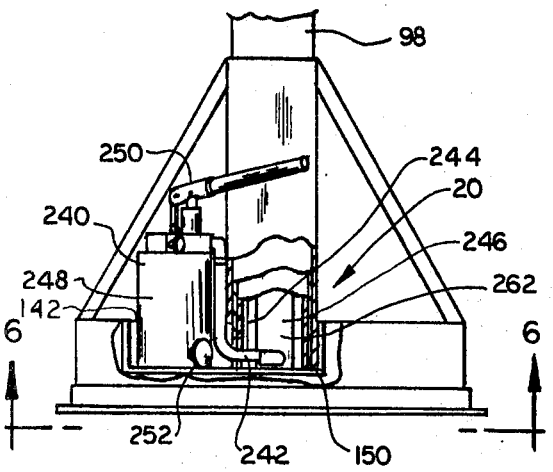
FIG. 5 is a fragmentary side elevational view of the four sided, foldable basketball goal means having an access door removed and portions broken away for clarity.

As shown in FIG. 5, the actuator control means 20 includes a fluid pump means 240 anchored to the stepped section 150 of the horizontal support plate 142; a pair of fluid flow channels 242, 244 connected to the pump means 240; and a piston and cylinder assembly 246 mounted within the telescoping tube member 101.

The pump means 240 is of a conventional nature having a pump housing 248, a pump handle assembly 250 connected to the pump handle assembly 250 connected to the pump housing 248 and a pump assembly (not shown); and a control valve 252 to direct fluid flow. The pump handle assembly 250 is operable in a conventional manner to supply pressure fluid or receive return fluid from the channels 242, 244 depending on operation of the control valve 252.

The flow channel 252 directs pressure fluid to a lower end of the piston and cylinder assembly 246 to raise the telescoping tube member 101. The other flow channel 244 directs pressure fluid to an upper end of the piston and cylinder assembly 246 to positively lower the telescoping tube member 101 for reasons to be explained.

As noted in FIG. 3, the piston and cylinder assembly 246 includes a piston assembly 255 mounted within a cylinder assembly 257 for axial movement relative thereto. The piston assembly 255 includes a piston head (not shown) in the cylinder assembly 257; a piston rod 257 connected to the piston head; and a connector head 258 secured to inner surfaces 260 of the telescoping tube member 101.

The cylinder assembly 257 includes a cylinder member 262 having a lower end pivotally connected to the horizontal support plate 142 to allow some relative movement of the telescoping tube member 101 to the main tube member 98 to prevent binding therebetween.

USE AND OPERATION OF THE INVENTION

As shown in FIG. 1, the four sided, foldable basketball goal means 12 is shown in the normal, usage condition with the basketball goal means 14 in the vertical condition and at proper height.

On desire to change height of the basketball goal means 14, the three lock assemblies 112 can be loosened to release the binding force between the main tube member 98 and the telescoping tube member 101. The access door member 154 is then opened to expose the actuator control means 20. A combination of the fluid pump means 240 and control valve 252 is operated to raise or lower the basketball goal means 14 to the desired height as may be lowered under 10 feet for young players.

In order to move the four sided, foldable basketball goal means 12 to the collapsed condition for storage or movement through conventional doors, the individual basketball assemblies 22 are movable to the inverted, folded condition as shown in FIG. 3. This is accomplished by removal of the nut and bolt member 92 (FIG. 4) to rotate the respective goal and rim assembly 24 about the connector shaft 68.

Next, the basketball goal means 14 is lowered on release of the three lock assemblies 122 and operation of the fluid pump means 240 as described above. Release of pressure fluid in the fluid flow channel 242 will move the basketball goal means 14 to the lowered position of FIG. 1.

In order to move the four sided, foldable basketball goal means 12 of this invention laterally, the actuator wheel assembly 132 has to be moved to the solid line positon as shown in both FIGS. 3 and 7. Next, the pump means 240 is actuated to supply pressure fluid through fluid flow channel 244 to the top side of the piston head. This acts as a positive pressure to move the telescoping tube member 101 downwardly to initially contact the actuator plate 236 as shown in FIG. 8. Further downward movement acts through the bearing members 232, 234 to contact the wheel actuator arms 212 to rotate the wheel assemblies 188, 190 about the respective support shafts 201 to the position shown in solid lines in FIG. 7.

In this position, the entire four sided, foldable basketball goal means 12 is supported on the outer surface of the wheel members 205 and 216 for ease of lateral movement thereof.

In this condition, the access door member 154 may be opened as shown in FIG. 10 and the handle member 166 extended to the position of FIG. 11. The latch member 168 then grasps the connector tube 170 to provide an axially aligned rigid connection between the handle members 166 and the access door member 154.

As the vertically and horizontally pivotal wheel members 205 are adjacent the access door member 154, the handle member 166 is readily used to pull or push the four sided, foldable basketball goal means 12 to any desired location for use or storage.

It is also noted that the rim assembly may be replaced with a releasable rim assembly (previously described) as a safety factor to further prevent tipping over of the four sided, foldable basketball goal means 12.

However, it is noted that tipping over of the four sided, foldable basketball goal means 12 of this invention is very remote because (1) the opposed individual basketball goal assemblie 22 tend to counterbalance each other; and (2) the weight and width of the goal support means 16 adds substantial stability thereto.

It is understood that the foldable basketball goal mean 12 may be of two or four sided construction with the two sided embodiment having the basketball goal assemblies 22 opposite each other for counterbalancing purposes.

It is also understood that a two sided embodiment can be easily expanded later to a four sided embodiment.

The four sided, foldable basketball goal means of this invention provides multiple basketball practice areas in a central open area, foldable basketball goal assemblies for moving through limited door heights, adjustable to different heights for persons of different ages; and readily movable when desired for storage or a different usage area.

While the invention has been described in conjunction with preferred specific embodiments thereof, it will be understood that this description is intended to illustrate and not to limit the scope of the invention, which is defined by the following claims.

I claim:

1. A foldable basketball goal means used to practice basketball exercises therewith, comprising:

(a) a basketball goal means having an individual basketball goal assembly;

(b) a goal support means having one end connected to said basketball goal assembly;

(c) a main base support means connected to a lower end of said goal support means;

(d) said basketball goal assembly includes a goal and rim assembly connected to said goal support means through a foldable support assembly;

(e) said goal and rim assembly having a basketball ring mounted on a conventional type basketball goal member;

(f) said foldable support assembly included a first support assembly having said basketball goal member pivotally connected to an outer end thereof, a goal support assembly connected to a backside of said basketball goal member, and a connector assembly mounted between said support assembly and said goal support assembly;

(g) said connector assembly may be selectively released from said support assembly to pivot a major portion of said goal and rim assembly forwardly and downwardly at least 180 degrees to a transport position for ease in moving through conventional door openings; and (h) when in an inverted position about 180 degrees downwardly, said goal and rim assembly extends even or below said goal support means for ease in moving through conventional door openings.

2. A foldable basketball goal means as described in claim 1, wherein:

(a) said basketball goal means includes four of said individual basketball goal assemblies, each facing an opposite outer direction extended outwardly of said goal support means to provide four individual basketball practice areas and counterbalancing weight to opposite pairs thereof to each other;

(b) each of said individual basketball goal assemblies being foldable to said downwardly transport position; and (c) when in an inverted transport position about 180 degrees downwardly, each of said goal and rim assemblies extended below said goal support means.

3. A foldable basketball goal means as described in claim 1, wherein:

(a) an actuator control means mounted on said main base support means and operably connected to said goal support means;

(b) said goal support means having a main support tube member and an upper telescoping tube member mounted in said main support tube member for axial movement relative thereto;

(c) said actuator control means includes a fluid pump means connected to a piston and cylinder assembly;

(d) said piston and cylinder assembly having a stationary lower end secured to said main base support means and an upper piston head end connected to said upper telescoping tube member;

(e) said fluid pump means is connected to upper and lower ends of said piston and cylinder assembly to supply pressure fluid thereto in order to be selectively operable to raise and lower said upper telescoping tube member;

(f) said main base support includes an actuator wheel assembly mounted in a base support assembly; and (g) said fluid pump means operable to force said upper telescoping tube member against said wheel actuator assembly under said pressure fluid to raise the entire said foldable basketball goal means for ease of transporting thereof.

4. A foldable basketball goal means as described in claim 3, wherein:

(a) said actuator wheel assembly includes a pivotal first wheel assembly; a pivotal second wheel assembly; and a wheel actuator assembly operably connected to said upper telescoping tube member and said first and second pivotal wheel assemblies;

(b) said fluid pump means operable to raise the entire said foldable basketball goal means upon said first and second pivotal wheel assemblies for ease of transporting thereof;

(c) said first and second pivotal wheel assemblies each having a main support shaft with wheel members mounted on opposite ends thereof, and an actuator linkage connected to said main support shaft; and (d) said actuator wheel assembly having a bearing actuator assembly engageable with said actuator linkage on use of said fluid pump means to raise and lower said wheel members to move from the usage postion to an elevated transport position.

5. A foldable basketball goal means as described in claim 1, wherein:

(a) said basketball goal means includes a pair of said individual basketball goal assemblies extended outwardly of said goal support means facing in opposite directions to provide two individual basketball practice areas and counterbalancing weight to each other;

(b) each of said individual basketball goal assemblies being foldable to said transport position; and (c) when in an inverted transport position about 180 degrees downwardly, each of said goal and rim assemblies extended below said goal support means.

6. A foldable basketball goal means as described in claim 1, wherein:

(a) said basketball goal means includes four of said individual basketball goal assemblies, each facing an opposite outer direction extended outwardly of said goal support means to provide four individual basketball practice areas and counterbalancing weight to opposite pairs thereof to each other;

(b) each of said individual basketball goal assemblies being foldable to said transport position; and (c) when in an inverted transport position about 180 degrees downwardly, each of said goal and rim assemblies extended below said goal support means.

7. A foldable basketball goal means as described in claim 1, wherein:

(a) said basketball goal assembly includes a goal and rim assembly connected to said goal support means through a foldable support assembly.

(b) said goal and rim assembly having a basketball ring mounted on a conventional type basketball goal member; and (c) said basketball ring of a pressure releasable type to move from a latched horizontal, usage position to a downward vertical position when excessive downward pressure is applied to said basketball ring and readily movable in an upward direction to the original said latched horizontal, usage position to resume basketball play and to prevent damage thereto plus prevent tipping over of the entire said foldable basketball goal means.

8. A foldable basketball goal means used to practice exercises therewith, comprising:

(a) a basketball goal means having an individual basketball goal assembly;

(b) a goal support means having one end connected to said basketball goal assembly;

(c) a main base support means connected to a lower end of said goal support means;

(d) said main based support means includes an actuator wheel assembly mounted within a base support assembly;

(e) said base support assembly includes a main support housing having a door and handle assembly connected thereto;

(f) said door and handle assembly having a handle assembly connected to a door member;

(g) said door member is pivotally connected to said main support housing and movable to an inclined, open position and said handle assembly having a handle member slidably mounted in a connector tube secured to said door member, said handle member grasped to move the entire said foldable basketball goal means to a desired position; and (h) said handle member movable within said connector tube to an extended position to move said foldable basketball goal means.

9. A foldable basketball goal means as described in claim 8, wherein:

(a) said handle assembly includes a latch member connected to one end of said handle member; and (b) said handle member having a handle section movable to an outward position with said latch member engaging said connector tube in a locked condition so that said handle member can either push or pull the entire foldable basketball goal means.

10. A foldable basketball goal means used to practice basketball exercises therewith, comprising:

(a) a basketball goal means having an individual basketball goal assembly;

(b) a goal support means having one end connected to said basketball goal assembly;

(c) a main base support means connected to a lower end of said goal support means;

(d) an actuator control means mounted on said main base support means and operably connected to said goal support means;

(e) said goal support means having a main support tube member and an upper telescoping tube member mounted in said main support tube member for axial movement relative thereto;

(f) said actuator control means operable to selectively move said upper telescoping tube member axially to raise and lower said basketball goal assembly as desired for the proper playing height or at a lower transport and storage height;

(g) said basketball goal assembly includes a goal and rim assembly connected to said goal support means through a foldable support assembly;

(h) said goal and rim assembly having a basketball ring mounted on a conventional type basketball goal member;

(i) said foldable support assembly includes a horizontal support assembly having said basketball goal member pivotally connected to an outer end thereof for movement of at least 180 degrees, a goal support assembly connected to an outer end thereof; a goal support assembly connected to a back side of said basketball goal member, and an inclined connector assembly mounted between said horizontal support assembly and said goal support assembly; and (j) said inclined connector assembly may be selectively released from said horizontal support assembly to pivot a major portion of said goal and rim assembly about 180 degrees forward and downwardly to an inverted transport position.

11. A foldable basketball goal means as described in claim 10, wherein:

(a) when in the inverted transport position, said goal and rim assembly extends even or below said goal support means for ease in moving through conventional door openings.

12. A foldable basketball goal means as described in claim 10, wherein:

(a) said basketball goal means includes four of said individual basketball goal assemblies, each facing an opposite outer direction to provide four individual basketball practice areas;

(b) all of said individual basketball goal assemblies are each pivotal about a horizontal axis from the upright usage position to an inverted position 180 degrees from the usage position; and (c) said upper telescoping tube member movable downwardly to a lowermost position to raise the entire said foldable basketball goal means for transport purposes.

* * * * *